US007237697B2

(12) United States Patent
Dunne

(10) Patent No.: US 7,237,697 B2
(45) Date of Patent: Jul. 3, 2007

(54) APPARATUS FOR DISPENSING AN ATOMIZED LIQUID PRODUCT

(75) Inventor: Stephen Terence Dunne, Stowamarket (GB)

(73) Assignee: Boehringer Ingelheim microParts GmbH, Dortmund (DE)

( * ) Notice: Subject to any disclaimer, the term of this patent is extended or adjusted under 35 U.S.C. 154(b) by 94 days.

(21) Appl. No.: 10/992,766

(22) Filed: Nov. 22, 2004

(65) Prior Publication Data

US 2005/0098588 A1 May 12, 2005

Related U.S. Application Data

(62) Division of application No. 10/319,571, filed on Dec. 16, 2002, now abandoned.

(30) Foreign Application Priority Data

Dec. 14, 2001 (GB) ..... 0130057.3
Jul. 19, 2002 (WO) ..... PCT/EP02/08053

(51) Int. Cl.
*B65D 83/16* (2006.01)
*B65D 83/32* (2006.01)
*B65D 83/36* (2006.01)
*B65D 83/62* (2006.01)

(52) U.S. Cl. ..... 222/402.18; 222/95; 222/402.25

(58) Field of Classification Search ..... 222/95, 222/386.5, 402.18, 402.25
See application file for complete search history.

(56) References Cited

U.S. PATENT DOCUMENTS 2,040,302 A 5/1936 Fortier
2,592,808 A 4/1952 Knapp
3,069,098 A 12/1962 Frangos et al.
3,608,781 A 9/1971 Flynn
3,610,481 A 10/1971 Marraffino
3,647,120 A 3/1972 Steiman
3,653,551 A 4/1972 Koch
3,658,254 A 4/1972 Lee
3,664,548 A 5/1972 Broderick
4,227,631 A 10/1980 Schneider
4,322,037 A 3/1982 Heeb et al.
4,354,638 A 10/1982 Weinstein
4,414,168 A 11/1983 Hankin
4,417,674 A 11/1983 Giuffredi (Continued)

FOREIGN PATENT DOCUMENTS

DE 32 39 600 4/1984

(Continued)

OTHER PUBLICATIONS

International Search Report PCT/EP02/08053, mailed Oct. 31, 2002.

*Primary Examiner*—Joseph A. Kaufman
(74) *Attorney, Agent, or Firm*—David S. Safran

(57) ABSTRACT

An apparatus for atomizing a liquid product using a propellant, which may be integrated into aerosol packs, for atomization of a liquid product. The liquid product may have a high viscosity. The total flow rate ranges from about 0.5 grams per second to about 0.01 grams per second through a single capillary tube. The liquid product is atomized within a capillary tube. The apparatus may be designed as a handheld unit or as a stationary or mobile unit using a plurality of capillary tubes.

14 Claims, 14 Drawing Sheets

U.S. PATENT DOCUMENTS

| | | | |
|---|---|---|---|
| 4,666,062 | A | 5/1987 | Pershall |
| 5,125,546 | A | 6/1992 | Dunne et al. |
| 5,180,085 | A | 1/1993 | Schmid |
| 5,337,929 | A | 8/1994 | Van de Heijden |
| 5,579,955 | A | 12/1996 | Sandou-Pascal et al. |
| 5,695,096 | A | 12/1997 | Yquel |
| 5,730,326 | A | 3/1998 | Kaeser |
| 5,918,817 | A | 7/1999 | Kanno et al. |
| 5,921,439 | A | 7/1999 | Losenno et al. |
| 5,957,333 | A | 9/1999 | Losenno et al. |
| 6,085,945 | A | 7/2000 | Fransen |
| 6,299,024 | B1 | 10/2001 | Corba |
| 6,464,960 | B1 | 10/2002 | Staehle et al. |
| 2002/0060255 | A1 | 5/2002 | Benoist |

FOREIGN PATENT DOCUMENTS

| | | |
|---|---|---|
| EP | 0 445 358 A2 | 9/1991 |
| EP | 0 445 358 B1 | 9/1991 |
| EP | 1 072 250 A2 | 1/2001 |
| EP | 1 072 250 A3 | 1/2001 |
| GB | 747379 | 4/1956 |
| GB | 1163573 | 9/1969 |
| WO | WO 92/12799 | 8/1992 |

APPARATUS FOR DISPENSING AN ATOMIZED LIQUID PRODUCT

CROSS-REFERENCE TO RELATED APPLICATION

This application is a divisional of U.S. patent application Ser. No. 10/319,571, filed on Dec. 16, 2002 now abandoned, which claims priority based upon International Patent Application No. PCT/EP02/08053, filed on Jul. 19, 2002, and UK Patent Application No. 0130057.3, filed on Dec. 14, 2001, all of which are herein incorporated by reference in their entirety.

BACKGROUND OF THE INVENTION

1. Field of the Invention

The present invention relates generally to an apparatus for atomizing a liquid product which can be integrated into aerosol packs, which may be pre-pressurized. Such an apparatus may be integrated into a spray can, which is operable by simply pushing a closure mechanism to open valves for dispensing the contents of the can.

2. Background of the Invention

A conventional apparatus for atomizing a liquid product containing the actual active ingredient uses pressure from a propellant, which is contained within a conventional storage container connected thereto or alternatively a pump to pressurize the storage container. Such known devices use a tube to transport the liquid product to be atomized to an atomizing nozzle where droplets are formed from the liquid product. In order to effectively atomize a liquid product by a conventional atomizing apparatus, comparatively large volumes of propellant, diluents and/or solvent, in relation to the liquid product are necessary, both for providing sufficient pressure for the atomization process and for reducing the viscosity of the liquid product, that has the actual active ingredient of the system. The propellant is conventionally used in a volumetric ratio of 2000:1 to 20,000:1 of gas to liquid product, when determined at atmospheric pressure. The propellant may be compressed air, nitrogen, or, conventionally a volatile organic compound such as butane and chlorinated or fluorinated hydrocarbons, which are liquid in a compressed state.

In conventional systems, the liquid product has to be diluted further by additional solvents, or diluents (such as, for example, liquefied natural gas), which also act as the propellant and reduce the amount of active ingredient atomized at the conventional high flow rates and/or reduces the viscosity of the active ingredient. The propellant itself may act as a solvent and/or diluents for the liquid product when contained within the same compartment as the liquid product, (such as, for example, when the propellant is liquefied natural gas, butane, chlorinated hydrocarbons, or fluorinated hydrocarbons). When both liquid product and propellant are contained within the same storage container, such as in the conventional "dip tube" systems, some of the propellant may disperse or dissolve into the liquid product. In order to reduce such high total flow rates of known dip-tube systems, they conventionally need a so-called vapor tap to allow inflow of additional propellant in its gaseous state, which reduces the flow rate of liquid mixture up the dip-tube. This reduction of the flow rate by additional gaseous propellant is used in conventional systems to reduce the amount of liquid product which is dispensed while maintaining a sufficiently high total flow rate which is necessary for a stable atomization.

In conventional systems, when liquid product is being dispensed, the effect of the propellant to act as a solvent or diluent for the liquid product is significantly reduced as the propellant changes into its gaseous phase, and becomes no longer available as a liquid solvent.

An apparatus for atomizing liquid product is disclosed in U.S. Pat. No. 5,921,439, which uses a nozzle to atomize a mixture of pressuring gas and liquid product. The liquid product and pressurizing gas form a mixture immediately before entering the atomizing nozzle, but are delivered to the mixing compartment by separate tubes. In the storage compartments, the pressurizing gas exerts its pressure also on the liquid product, which is isolated from the pressurizing gas within a collapsible bag, surrounded by pressurizing gas.

U.S. Pat. No. 5,918,817 discloses a two-fluid cleaning jet nozzle, which has an atomizing unit by which pressurized gas can atomize a liquid into droplets. The cleaning jet nozzle in U.S. Pat. No. 5,918,817 consists of two portions, namely a so-called atomizing tube and a cross-sectional area of 7–200 $mm^2$ into which the liquid and gas are introduced. This atomizing tube is provided with one exit port, which continues into an accelerating tube having a smaller diameter than the atomizing tube, namely 3–15 $mm^2$. As a result of the smaller cross-sectional area of the accelerating tube being fed from the atomizing tube which has a larger cross-sectional area, the velocity of the exiting fluid droplets is much higher than for conventional nozzles without a smaller diameter accelerating tube adjacent to the atomizing tube. This two-compartment jet nozzle provides almost double the exit velocity of atomized fluids at the same pressure of the propellant gas in comparison to the conventional jet nozzle, i.e., approaching the speed of sound at a supply pressure of gas about 3 bar. It becomes clear from the drawing, that the entrance port for the gas is always of a bigger cross section than the entrance port for liquid. U.S. Pat. No. 5,918,817 emphasizes the importance of a high velocity and a high volume to be obtained for the stream of liquid droplets in order to effectively remove contamination from the surface of silicon wafers.

Conventional aerosol spray systems typically produce flow rates of 0.5 to 3 grams-per-second (g/s) of product, where the product is a mixture of liquefied propellant gas, a diluent or solvent and a small amount of active ingredient. In these systems, both the propellant gas and the diluent or solvent are often volatile organic compounds, such as butane and ethanol. These volatile organic compounds are included to produce a spray with a "cool feel" as they quickly evaporate leaving behind just the active ingredient on the sprayed surface (such as, for example the skin) or suspended in the air. Conventionally, a mixture of organic compounds is needed for adjusting the viscosity and solvency of the active ingredient (i.e., a liquid product without added volatile organic compounds). The volumetric ratio of gas (at atmospheric pressure) to active liquid product is typically between 2000:1 and 20,000:1. The propellant gas, the solvents and diluents are released into the atmosphere, which generates environmental problems.

It has been shown that conventional valve arrangements for atomizing apparatuses necessitate the use of flow rates of propellant and liquid product including any diluents in the order of 0.5 grams per second to 1.5 grams per second in order to avoid unstable (i.e., oscillating) flow. With lower total flow rates, the flow at the exit port becomes unstable and discontinuous, i.e., it oscillates. In order to reduce such high flow rates of propellant, dip-tube systems conventionally need a so-called vapor tap to allow inflow of additional propellant in its gaseous state.

The design of conventional atomizing valves usually has an internal cavity volume arranged between afferent pathways for delivering liquid product and/or propellant and the exit. For example, the atomizing nozzle is at least 100 $mm^3$ and the total cavity volume, including valve body, stem and actuator, is between 100 and 300 $mm^3$.

SUMMARY OF THE INVENTION

Therefore, it is an object of the present invention to provide an apparatus for atomizing a liquid product that can form small liquid droplets using the pressure of a propellant while requiring a significantly reduced amount of propellant gas in relation to the liquid product being atomized. For the purposes of this disclosure, the term "liquid product" refers to a composition that is in a liquid state at room temperature, contains the active ingredient, which is formulated as a solution, suspension, or dispersion (such as, for example, hairspray, a paint composition) containing the diluent only necessary for formulating the active ingredient such as soluble resins or dispersible particles (for example, paints or hairspray), without necessarily incorporating additional diluents in admixture.

It is a further object of the present invention to provide an apparatus for atomizing a liquid product the using pressure of a propellant to effectively atomize a liquid product, having a higher viscosity than for example water, into small droplets while requiring a reduced amount of propellant.

It is a further object of the present invention to provide an apparatus for atomizing a liquid product, wherein the liquid product may be viscous, for example having a viscosity above that of, for example, water, in order to avoid the use of a diluent contained in the liquid product.

Furthermore, it is an object of the present invention to provide an apparatus for atomizing a liquid product, in which the liquid product may be viscous, using a comparatively low proportion of propellant to liquid product dispensed, while providing for a non-oscillating (i.e., stable) stream of atomized liquid product at the exit port.

In one embodiment, the present invention arrives at the objects of the invention by providing an apparatus for atomizing a liquid product, using the pressure of a gaseous propellant. The liquid product is atomized within a capillary tube. The apparatus of the present invention is designed for a total flow rate from about 0.5 grams per second to about 0.01 grams per second, preferably from about 0.3 grams per second to about 0.05 grams per second through a single capillary tube. Further embodiments of the apparatus and of the process of the present invention are described in the instant specification, including the claims.

The apparatus contains at least one capillary tube. One axial opening of the capillary tube is used for the discharge of the atomized liquid product, i.e., as an exit port. Also arranged on the capillary tube is at least one first entry port for entry of the liquid product which is distant from the exit port. At least one second entry port may be provided for entry of the propellant. By properly dimensioning the diameter of the capillary tube and the length or distance between the exit port and an adjacent entry port, either a first or a second entry port, the entering liquid product is atomized within the capillary tube by entering propellant. The liquid product is delivered to the first entry port by a pipe or tube, the propellant is delivered to the at least one second entry port by a separate pipe or tube. Depending on the type of storage container connected to this apparatus, a liquid product may be contained within the same container as the propellant or may be separated from the propellant.

In one embodiment of the atomizing apparatus of the present invention, essentially no propellant functions as a diluent for the liquid product and the two components are separated and fed to their respective entry ports essentially separately. In one embodiment of the present invention in which liquid product and propellant are kept separated from each other, the propellant may still pressurize the liquid product, which may be contained for example in a collapsible bag or in a cylinder having a movable piston being pushed by the propellant, where the cylinder is arranged within a canister containing the propellant. The, liquid product and propellant can be separated from each other by phase. When compressed gases, such as air or nitrogen, are used as the propellant, the compressed gases do not form a liquid phase at the pressure used. These compressed gases may be in direct contact with the liquid product, although a small amount of dissolution of the gas phase into the liquid product may occur.

In a preferred embodiment of the present invention, the first entry port is formed by the axial opening of the capillary tube opposite to the exit port and the at least one second entry port is arranged between the two axial openings.

In an embodiment of the present invention, a capillary tube has an inner diameter of from about from about 0.1 mm to about 1.0 mm, preferably from about 0.2 mm to about 0.6 mm. An essential feature of the present invention regarding the length of the capillary or distance between exit and entry port is that the length or distance between the exit port and the adjacent entry port, either a first or a second entry port, covers a range from about 5 mm to about 100 mm, preferably from about 5 mm to about 50 mm.

The diameters of the first and second entry ports are designed such that at normal atmospheric pressure, a volumetric flow ratio of liquid product to propellant is adjusted from about 1:50 to about 1:5000, preferably from about 1:100 to about 1:300. In general, the first entry port has a diameter of from about 0.1 mm to about 2.0 mm, preferably from about 0.2 mm to about 1.0 mm, more preferably from about 0.3 mm to about 1.0 mm, even more preferably from about 0.4 mm to about 0.7 mm. When used, the second entry port generally has a diameter from about 0.1 mm to about 0.7 mm, preferably from about 0.15 mm to about 0.50 mm, more preferably from about 0.24 to about 0.35 mm.

The diameter of the first entry port may be formed by a flow restrictor when the first entry port is the axial opening of the capillary tube. Such a flow restrictor may be formed by an insert into the capillary tube, decreasing its inner diameter. Furthermore, such a flow restrictor, which decreases the inner diameter of the capillary tube, may be inserted into the capillary tube between the exit port and the adjacent entry port.

As an alternative to using a separate first and second entry port for delivering liquid product and propellant to the capillary tube, respectively, another embodiment of the present invention utilizes an admixture of liquid product and propellant that is fed to the capillary tube, having just one entry port. For this embodiment, the same dimensions as described for the capillary tube apply. As the single entry port, for example, the axial opening opposite to the exit port may be used.

The embodiment of the present invention, which uses a common afferent pathway for both liquid product and propellant to the capillary tube, is applicable for instance in so called "dip-tube" systems, in which wherein the afferent pathway consists of a tubing reaching down into the liquid phase of admixed liquid product together with liquefied propellant, which may be liquefied hydrocarbon, optionally chlorinated or fluorinated and connective cavities to the entry port of the capillary tube.

For the embodiments having one common afferent pathway for both the liquid product and the propellant, when using a propellant which forms a liquid phase at the pressure used, generating a liquid admixture of liquefied propellant with the liquid product itself, the afferent pathway has no need for a lateral opening, also referred to as vapor tap. However, when a compressed gas is used as the propellant, which is phase-separated from the liquid phase (such as, for example, compressed air or nitrogen) the dip-tube needs a lateral opening for admitting propellant into the afferent pathway in a section of the dip-tube which is not immersed in liquid product when the container is in the position where it is actuated to dispense liquid product.

Furthermore, in the embodiment of the present invention applicable to the "dip-tube", wherein the liquid propellant forms one phase with the liquid product itself, i.e., the liquid propellant is separated by phase or physical barriers from the liquid product, the present invention achieves the atomization of liquid product within the capillary tube using only propellant forming a liquid phase with a liquid product, without the need for an additional entry opening within the afferent tubing (i.e., additional entry port or vapor tap) to allow entrance of additional gaseous propellant. An additional entry port (also called a vapor tap, which allows the additional entrance of gaseous propellant into the atomizing unit), is not necessary for the present invention, when liquefied gases are used to form a liquid phase as the propellant.

Furthermore, it is an essential feature of the present invention that the low flow rate of propellant in relation to liquid product, when compared to conventional systems, allows the liquid product to atomize without oscillations in the flow at the exit port, i.e., without discontinuous bursts out of the exit port. In order to achieve a stable and continuous (i.e., non-oscillating) flow of atomized liquid product out of the exit port, when using a comparatively low volumetric ratio of liquid product to propellant, and a comparatively low volumetric total flow rate of propellant and liquid product, the apparatus and process of the present invention provide internal dimensions of the afferent pathways to the capillary tube that avoid internal spaces and cavities. In an embodiment of present invention, the afferent tubing's and pipes or the single pipe in the case of the dip-tube system, are connected to the capillary tube, and include interposed valve mechanisms in which the internal cavities are not large enough to produce an oscillating flow under the conditions described.

The internal cavity formed between afferent tubing and entry port into the capillary tube has a volume of below about 50 $mm^3$, preferably below about 20 $mm^3$, more preferably below about 6 $mm^3$ and most preferably below about 2 $mm^3$.

With the low total volumetric flow rate, the present invention achieves the same liquid product (active ingredient) flow rate as in conventional systems; however, the diluents necessary in conventional systems can be omitted to a substantial degree. One reason why the present invention can achieve this results is that the high viscosity of the liquid product is no longer an obstacle to atomization at low total flow rates. Another reason, more importantly, is that the present invention uses only comparatively low total flow rates of liquid product plus propellant.

In general, the combination of low total flow rate of propellant and liquid product and the low ratio of propellant to liquid product, which can be realized with the atomization apparatus according to the present invention, allows liquid product (active ingredient) to be dispensed at the same rate as conventional systems; however, the apparatus and process of the present invention use less propellant and substantially less diluents than necessary in conventional systems.

The volume of cavities containing the admixture of liquid product and propellant in the apparatus of the present invention, which are created between the one or more afferent tubings and the actual atomizing capillary tube, need to be controlled to be under a certain volume in order to allow continuous and stable (i.e., non-oscillating) flow to the exit port while still using low total flow rates and, additionally, low ratios of propellant to liquid product.

The apparatus of the present invention provides an inner diameter of the capillary tube atomizer that affects the flow rate of the atomized liquid product inside the capillary.

Persons of skill in the art can determine the maximum cavity volume, which is defined as the void volume between the afferent pathway(s) for liquid product and/or propellant and the entrance port(s) to the capillary tube, to determine the dimensions applicable in the present invention. As a guideline, the following considerations can be followed:

At a viscosity of 50 mPa·s (for example vegetable oil) the relationship can be calculated as:

$$\text{Maximum cavity volume allowed} = \text{Pressure}^{1.5} \exp[(d/R - 0.621)/0.2022]$$

At a viscosity of 1 mPa·s (for example water) this relationship changes to:

$$\text{Maximum cavity volume allowed} = \text{Pressure}^{1.5} \exp[(d/R - 0.4274)/0.1917], \text{ where d}$$

is the capillary tube internal diameter in mm, and wherein R is the ratio of the diameters of the entry port for propellant to the entry port (which was a 40 mm long capillary tube) for liquid product (which may be defined by a restrictor inserted into the axial opening of the capillary tube), and wherein the internal diameter of the capillary tube is given in mm, the pressure is gauge and is given in bars and the maximum volume cavity allowed is calculated in $mm^3$.

If a larger cavity volume is used that is larger than or above the maximal cavity volume allowed, then an unstable and/or oscillating flow is created when using the intended total flow rate.

From the above considerations, a person of skill in the art can determine the volumes of sufficiently small cavity, when using values for viscosity and geometry that differ from those given above, in order to provide a capillary tube atomizer which produces a continuous (i.e., non-oscillating) flow of the atomized liquid product at low ratios of propellant to liquid product.

Furthermore, the above relations show that, for a given system, an increase in R or a decrease in the pressure applied can lead to unstable or oscillating flows.

Embodiments of the present invention that provide the above relationships are described in the following examples. In a preferred embodiment, the cavity volumes are reduced by a factor of 10 to 100 as compared to the cavity volumes of conventional systems in order to arrive at a non-oscillating atomization of liquid product when using comparatively lower ratios of propellant to liquid product. In preferred embodiments according to the present invention, the cavity volume between the afferent pathway(s) and the entry port(s) to the capillary tube is between 0 and 20 $mm^3$ and preferably below 10 $mm^3$.

In the above calculations, when applied to a dip-tube system using just one afferent pathway between storage container and capillary tube with no additional opening within the afferent pathway for entrance of additional propellant, the ratio R becomes 1 and is to be replaced by the volumetric ratio of propellant to liquid product within the uniform mixture of liquid product and propellant.

In order to operate this atomizing apparatus embodiment of the present invention, valves are used to open and to shut off the flow of the liquid product and/or propellant and/or the mixture of liquid product and propellant before the exit port. Therefore, a single on/off valve may be arranged on the capillary tube between the exit port and the adjacent entry port to completely block the capillary tube cross-section. In addition, or as a separate embodiment, two valves may be arranged to separately block or regulate the flow of propellant to the second entry port and the flow of liquid product to the first entry port. These two valves may be actuated in parallel and simultaneously. Further, in order to avoid liquid product accumulating in the capillary tube, the valve controlling the inflow of propellant into the second entry port may be used to admit propellant shortly before and after entry of liquid product.

For the purposes of the specification, pressures given are defined as pressure gauge, i.e., the pressure above normal atmospheric pressure, unless otherwise indicated.

The propellant may be natural gas, such as for example liquefied butane, propane or a halogenated or fluorinated hydrocarbon. However, an environmentally friendly propellant such as compressed air or nitrogen may be used as the propellant. In some cases, such as when low flow rates of propellant are necessary, even compressed carbon dioxide, compressed air or nitrogen may be used as the propellant.

When dimensioning the atomizer according to the invention, it is to be taken into account that the geometry will influence the flow rates of liquid product and propellant as well as the particle size of the droplets of liquid product produced. In detail, the particle size essentially depends on the ratio of diameters of first entry port to second entry port. Generally, the lower this ratio, the smaller the particles will be when both liquid product and propellant are under the same pressure.

The flow rate at the exit port is mainly a function of the inner diameter of capillary tube, such as, for example, a smaller inner diameter of the capillary tube will result in a lower flow rate at the same pressure for propellant and liquid product.

In accordance with the particle size being influenced by the ratio of cross-sections of the first entry port to the second entry port, the particle size is accordingly influenced by the volumetric ratio of liquid product to propellant. The lower the ratio of liquid product to propellant, the smaller the particles will be at the exit port.

Therefore, the following measures are to be taken to adjust the dimensions of the atomizer according to the invention: If the particles produced at the exit port are too big, the ratio of liquid product to gas is decreased. In embodiments in which the liquid product is stored separate from the propellant (such as, for example, the liquid product contained within a collapsible bag compressed by the propellant), the ratio of the diameter of the first entry port to the diameter of the second entry port is decreased. In the case for the dip-tube arrangement embodiment, wherein propellant gas and liquid product are contained within the same canister, the volumetric ratio of liquid product to propellant shall be decreased.

In order to decrease the flow rate and the cross section of the exit port, the inner diameter of the capillary tube is decreased, or, alternatively, the ratio of liquid product to propellant is decreased.

When an acceptable particle size is initially obtained with a flow rate that is too high at the exit port, the flow rate can be regulated by decreasing the inner diameter of the capillary tube or inserting flow restrictors into the capillary tube. Further, when an acceptable particle size is initially obtained with a flow rate that is too low at the exit port, the flow rate can be regulated by increasing the inner diameter, i.e., the cross-section of the capillary tube.

When the flow rate at the exit port that is initially obtained is acceptable but the droplets produced are too large in size, the droplet size is decreased by decreasing the ratio of liquid product to propellant and increasing the inner diameter of the capillary tube. When the particles produced at the exit port are too small but the flow rate initially obtained is acceptable, the particles are enlarged by increasing the ratio of liquid product to propellant and either decreasing the inner diameter of the capillary tube or inserting flow restrictors.

In one embodiment of the present invention, the apparatus is used to atomize liquid products having a dynamic viscosity from 0.3 mPa·s to 5000 mPa·s.

The following design examples of the apparatus and process according to the present invention indicate the dynamic viscosity of the liquid product. In these examples, the liquid product was contained within a collapsible bag surrounded by propellant gas, both placed within a closed canister. The pressure of the propellant gas was approximately 3 bar gauge. For the purposes of this specification, unless otherwise indicated, the pressures given are defined as pressure gauge, i.e., the pressure above normal atmospheric pressure.

In the following example, the first entry port is the axial opening of the capillary tube, the second entry port was arranged at a distance of 20 to 40 mm from the exit port.

TABLE 1

| Example | dynamic viscosity [mPa · s] | diameter of first entry port [mm] | diameter of second entry port [mm] | capillary tube diameter [mm] |
|---|---|---|---|---|
| 1 | 1–3 | 0.3–0.4 | 0.15–0.29 | 0.3–0.4 |
| 2 | 3–10 | 0.4–0.7 | 0.24–0.35 | 0.4–0.7 |
| 3 | 10–20 | 0.4–0.7 | 0.24–0.35 | 0.4–0.7 |
| 4 | 20–40 | 0.7–1.0 | 0.28–0.50 | 0.7–1.0 |

Examples 5 and 6 were performed with a setup separating the liquid product from the propellant at a pressure of 2 bar and a distance of 40 mm between the exit port of the capillary tube and the adjacent second entry port, with the first entry port being the axial opening of the capillary tube opposite to the exit port.

TABLE 2

| Example | dynamic viscosity [mPa · s] | diameter of first entry port [mm] | diameter of second entry port [mm] | capillary tube diameter [mm] | mass mean diameter of droplets [μm] |
|---|---|---|---|---|---|
| 5 | 13 | 0.4 | 0.29 | 0.4 | 40 |
| 6 | 13 | 0.4 | 0.35 | 0.4 | 24 |

In a further embodiment of the present invention, the liquid product may be stored in a long tube having a diameter that provides a constant flow of liquid into the first entry port, if the valves are open. Such a tube may include a series of internal restrictions that permit the effective length of the tube to be reduced and, as the liquid is used up, less pressure is then required to create the desired flow of liquid and a decreasing pressure resulting from the compressed gas propellant being used up can be compensated by selecting tube length, tube diameter and restrictors. The droplet size was measured using a laser diffraction system, namely a Malvern particle size analyzer.

TABLES 3A AND 3B

Examples of dimensions for an atomizing apparatus with a storage compartment for liquid product that is separated from propellant, pressurizing the liquid product (bag-on-valve-type)

TABLE 3A

| Atomized liquid product: oil (50 mPa · s) | | | | | |
|---|---|---|---|---|---|
| Cavity Volume | Diameter of entry port for propellant | Diameter of entry port for liquid product | Pressure | Diameter of capillary tube | Flow rate (grams/second) |
| 130 $mm^3$ (a) | 0.5 mm | 1.0 mm | 2.7 bar | 0.50 mm | 0.60 g/s |
| Example 1 6 $mm^3$ | 0.5 mm | 1.0 m | 2.7 bar | 0.27 mm | 0.15 g/s |
| Example 2 2 $mm^3$ | 0.5 mm | 1.0 mm | 2.7 bar | 0.17 mm | 0.06 g/s |

(a) comparative example for a conventional spray can

TABLE 3B

| Atomized liquid product: water (1 mPa · s) | | | | | |
|---|---|---|---|---|---|
| Cavity Volume | Diameter of entry port for propellant | Diameter of entry port for liquid product (restrictor) | Pressure | Diameter of capillary tube | Flow rate (grams per second) |
| 130 $mm^3$ (a) | 0.27 mm | 0.4 mm | 2.7 bar | 0.55 mm | 0.60 g/s |
| Example 3 6 $mm^3$ | 0.27 mm | 0.4 mm | 2.7 bar | 0.24 mm | 0.12 g/s |
| Example 4 2 $mm^3$ | 0.27 mm | 0.4 mm | 2.7 bar | 0.14 mm | 0.04 g/s |

(a) comparative example for a conventional spray can

A graphic representation of the results in Tables 3A and 3B is given in FIG. 1.

APPLICATION EXAMPLES

In the following, two embodiments of the apparatus according to the invention are compared for the same liquid product. The "bag-on-valve type" atomizing apparatus used a propellant, which is exchangeably compressed gas such as air or nitrogen, which does not form a liquid phase at the pressures employed, as well as liquid natural gas. The propellant is contained within a container and has access to the capillary tube atomizer via a lateral entry port of the afferent pathway, whereas the liquid product is contained within a physically separated compartment such as a collapsible bag or a cylinder with a movable piston, which compartment is connected to the afferent pathway, for example to one axial opening of an afferent tubing forming part of the afferent pathway.

The alternative embodiment, here termed "dip-tube", employs one afferent pathway to the atomizing capillary tube, which afferent pathway does not have an additional entry port for e.g. gaseous propellant. In contrast, the afferent pathway only has one opening, for example the axial opening of an afferent tubing, which connects to the pathway leading to the capillary tube atomizer. Accordingly, a mixture of liquid product and liquid propellant enters into the afferent pathway, which mixture is not changed in respect of its ratio of propellant to liquid product by additional propellant entering the afferent pathway in its gaseous form.

TABLE 4

| | Bag-On-Valve | Dip-Tube |
|---|---|---|
| Total flow rate of liquid product plus propellant | 0.02–0.2 grams per second (or higher) | 0.05–0.3 grams per second (or higher) |
| Viscosity of liquid product (active ingredients including solvents) | 1–50 mPa · s | 1–50 mPa · s |
| Propellant (volume) | 20–80% | 20–80% |
| Size of atomized particles | 20–100 μm (a) | 20–100 μm (a) |
| Spray angle | 18° (16°–20°) | 18° (16°–20°) |

(a) mass mean diameter

TABLE 5

The following compositions for a hairspray may be used to produce exactly the same particle size and spray angle of atomized liquid product.

| | Composition for conventional spray can | Composition for bag-on-valve or dip-tube system according to the invention |
|---|---|---|
| Resin (solid) | 2 ml | 2 ml |
| Propellant | 30 ml | 8 ml |
| Ethanol | 50 ml | 7 ml |
| Water | 17 ml | 3 ml |
| Total content | 100 ml | 20 ml |
| Concentration of resin | 2% | 10% |
| Total flow rate of system | 1 g/s | 0.2 grams per second |
| Flow rate of resin | 0.02 grams per second | 0.02 grams per second |
| Reduction of propellant | n.a. | 73% |
| Reduction of ethanol | n.a. | 86% |
| Reduction of water | n.a. | 82% |
| Total content reduction | n.a. | 80% |
| Flow rate reduction | n.a. | 80% |
| Active reduction | n.a. | none |

n.a. = non applicable,
% = in relation to conventional spray can composition

The atomizing apparatus of the present invention can use a reduced amount of propellant and diluents to achieve the same flow rate of active ingredients, such as in the case of solid resin and when comparing flow rates of atomized formulations of hairsprays atomized using either a conventional spray can or the apparatus according to the invention. In other words, the apparatus according to the invention for atomizing the liquid product produces a spray of the active ingredients at the same rate while using a lower total flow rate of liquid product plus propellant in combination with a reduced amount of propellant per amount of active ingredient.

The mass mean particle size is generally adjustable from 2 μm to 100 μm with the atomizing apparatus according to this invention.

The advantages of the apparatus for atomizing a liquid product according to the invention are that a very low total flow rate can be used to spray concentrated, e.g. viscous fluids, with a small amount of gaseous propellant. As examples for liquid fluids, air fresheners, insecticides, hair sprays, body sprays, perfumes and deodorants, colorant compositions, chemically active compositions, lubricants or fuel can be formed to droplets. As a high viscosity of the liquid product is no further an obstacle to atomizing, at such low total flow rates the apparatus for atomizing according to this invention nearly eliminates the need for volatile organic compounds such as alcohols, butane or dimethylether as diluents to be included into the liquid product for reducing its viscosity.

Although the formation of small droplets from the liquid product is achieved within the capillary tube which is fed by the liquid product and propellant, an additional small nozzle, such as a swirl chamber nozzle, may be provided at the exit port for further decreasing the droplet size.

For regulating and actuating the apparatus according to the invention, valves can be located at several positions. In one embodiment, a central valve can be arranged on the capillary tube between the exit port and the adjacent entry port in order to block further movement of propellant and atomized liquid product towards the exit port. However, this embodiment is disadvantageous in respect of possible mixing of propellant and liquid product via the connecting portion of the capillary tube, where liquid product is separately stored from the propellant, such as for example in a collapsible bag arranged within the propellant contained in a canister.

As a further embodiment, two separate valves can be used to block the pipe or tubings delivering liquid product and propellant to the first and second entry ports, respectively. These two valves can be actuated simultaneously or in such a manner that the valve controlling the second entry port allows inflow of propellant before, during and after liquid product is admitted into the capillary tube.

Furthermore, valves may be used which meter the amount of liquid and/or propellant so that for each actuation of the valves, an adjustable amount is dispensed.

When employing the apparatus according to the invention, the liquid product containing the active ingredient can be dispensed with only a small amount or no diluent. Therefore, the liquid product is highly concentrated and very small flow rates can be achieved in comparison to conventional systems. As a consequence, the liquid product can reach for example skin without a large amount of diluents such as volatile organic compounds, resulting in a dry feel of the atomized liquid product as only little or no energy is necessary for the evaporation of volatile organic compounds. When using the atomizing apparatus according to the present invention, the flow rate of active ingredient, as defined, with only small amounts of diluents necessary for dissolving or dispersing the actual active ingredient, the flow rate of active ingredient can remain at the same level as in conventional systems, however, using a greatly reduced total flow rate of propellant and the active ingredient combined.

The present invention uses pressures for the gaseous propellant from 2 bar to 5 bar (200 kPa to 500 kPa), preferably 2 bar to 4 bar and even more preferably 2 bar to 3 bar.

The total flow rate within the capillary tube within which atomization of liquid product takes place is restricted to the range specified above. In order to scale up the total flow rate of an apparatus for atomizing liquid product within a capillary tube a plurality of capillary tubes may be used which are arranged in a bundle, a row or in another way. Every capillary tube of such plurality of capillary tubes may be supplied with liquid product to be atomized and propellant taken from the same source respectively. A few capillary tubes for atomizing liquid product may be supplied with several different liquid products and the same propellant or several propellants taken from the same source or different sources. In this case the liquid products come into contact with each other after the single liquid product has been atomized. The liquid product to be atomized and the propellant may be taken out of containers having relatively small volumes which are combined with preferably one or a few capillary tubes. This arrangement may result in a handheld unit.

Furthermore, the liquid product to be atomized and the propellant may be taken out of containers having relatively large volumes or may be taken out of pipelines. These pipelines are preferably connected to a plurality of capillary tubes. In this case a continuous or quasi continuous operation of the atomizer is possible. This arrangement may result in a stationary or mobile unit for continuous or quasi continuous atomization of liquid product. The total flow rate of such a unit is appreciably greater than the total flow rate through only one of the single capillary tubes.

The present invention will now be described in greater detail with reference to the embodiments of the invention described in the figures. Identical reference numbers refer to respective parts.

BRIEF DESCRIPTION OF THE DRAWINGS

The figures merely represent possible embodiments of the present invention. The figures are not intended to limit the invention to any of the preferred embodiments described in the drawings. They show:

FIG. 13 shows an embodiment that is applicable, for example to a dip-tube system using liquefied gas as the propellant.

FIGS. 14, 15, 16, 17 and 18 show exemplary embodiments of the present invention that are applicable, for example, for use in a "bag-on-valve" type spray can system.

Figure 1:
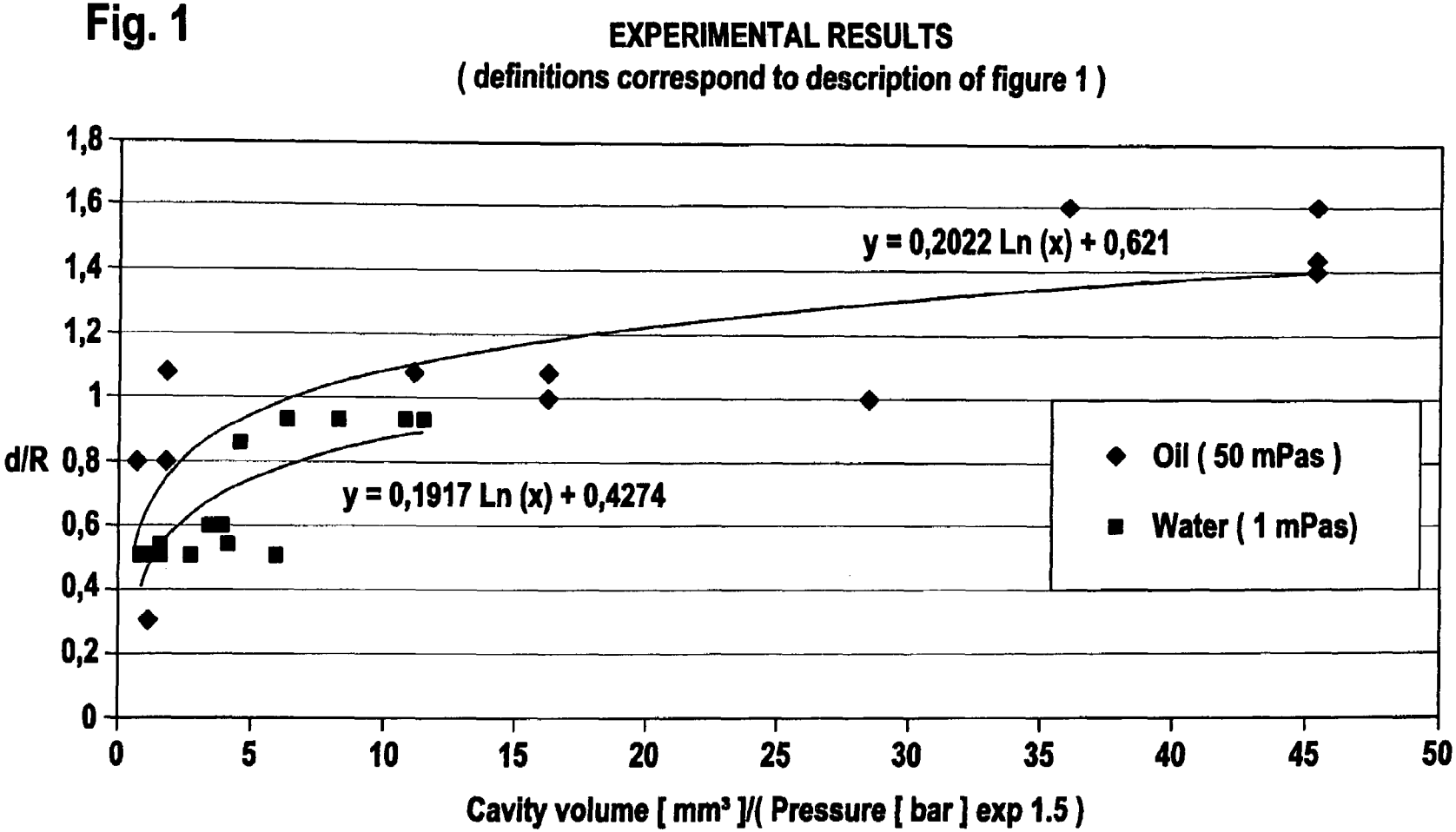
FIG. 1 is a graphical representation of the experimental results described in Tables 3A and 3B, according to an embodiment of the invention.

The following list of reference numbers identifies examples of some of the structures discussed in the figures and in the detailed description of the embodiments.

LIST OF REFERENCE NUMBERS

1 canister
2 propellant
3 flexible bag
4 capillary tube
5 exit port of capillary tube
6 liquefied gas
7 liquid product
8 valve
9 valve
10 bore
11 flow restrictor
12 inner passageway
12 first entry port
14 second entry port
15 common entry port
16 valve arrangement
17 valve arrangement
18 bore
19 cavity
20 afferent tubing
21 cover
22 sealing ring
23 housing
24 gasket
25 stem
26 coil spring
27 transverse bore
28 afferent bore
29 sealing
30 gasket
31 space
32 flexible partition wall
33 chamber
34 chamber
35 lateral bore
36 connecting bore
37 connecting bore

DETAILED DESCRIPTION OF THE INVENTION

FIG. 1 is a graphical representation of the experimental results described in Tables 3A and 3B.

For clarity of demonstration the following FIGS. 2 through 19 show embodiments of the apparatus according to the invention for atomizing liquid product. In one embodiment of the present invention, in which the pressure of a gaseous propellant is used to atomize the liquid product, only a single capillary tube is used within which the liquid product is atomized. Not shown in the figures are embodiments of the present invention that employ a plurality of capillary tubes within each of which atomization of liquid product takes place.

Figure 2:
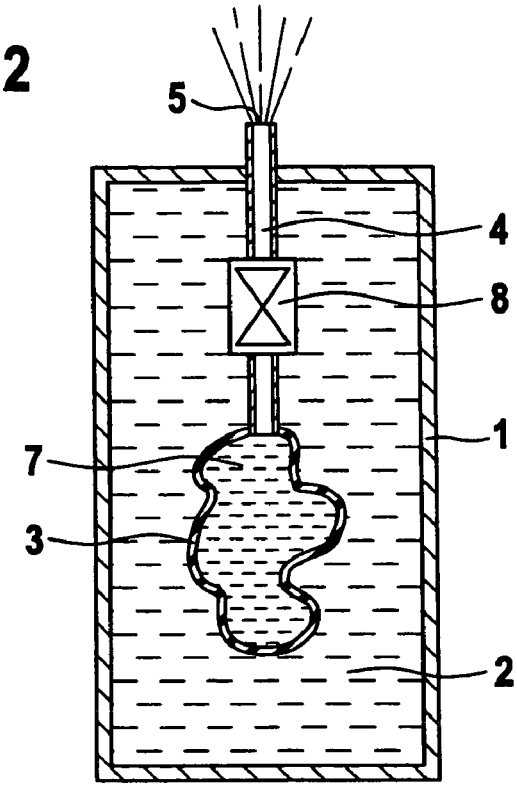
FIG. 2 shows an exemplary atomizing apparatus according to an embodiment of the invention.

FIG. 2 schematically shows a first embodiment of the apparatus of the present invention, in which a canister 1 contains a propellant 2. A flexible bag 3, arranged within the canister 1, contains the liquid product 7 and is pressured by the propellant 2. The flexible bag 3 is connected to the capillary tube 4 via valve 8, which in this case also allows the entry of propellant into the capillary tube 4. The capillary tube 4 is open to the environment at its exit port 5.

Figure 3:
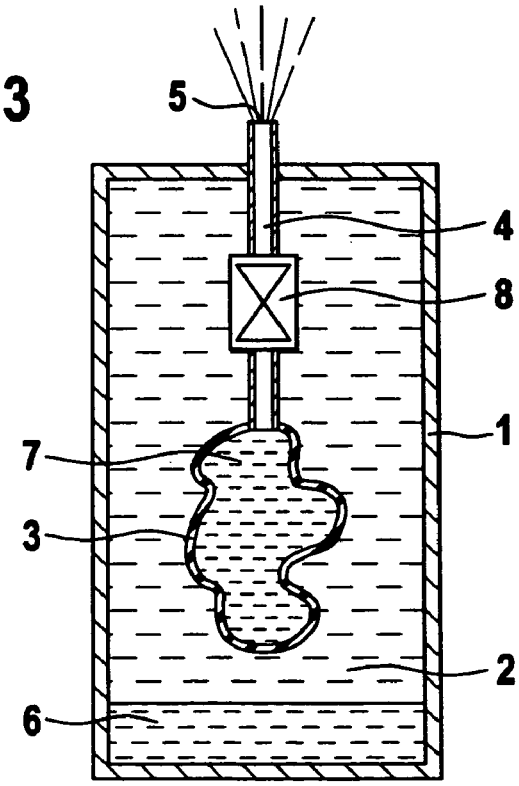
FIG. 3 shows an exemplary atomizing apparatus according to an embodiment of the invention.

In FIG. 3, showing a further embodiment of the apparatus according to FIG. 2, liquefied gas 6 is contained within the canister 1 from which a propellant 2 is formed.

Figure 4:
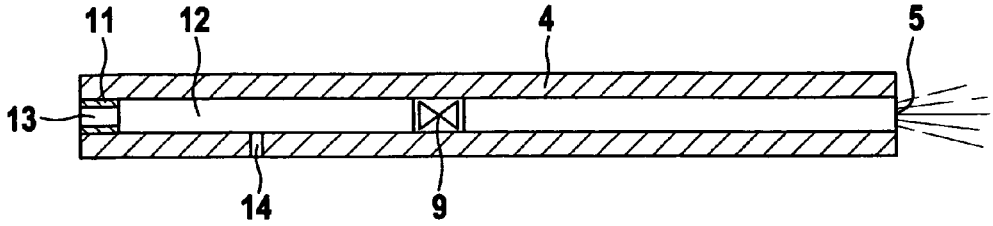
FIG. 4 shows a section of the capillary tube used in an exemplary atomizing apparatus according to an embodiment of the invention.

FIG. 4 shows a section of the capillary tube used for atomizing the liquid product according to the invention. The capillary tube 4 has an inner passageway 12, which is open to the environment at the exit port 5. Entry ports 13, 14, used as first and second entry ports, respectively or vice versa, allow the entry of liquid product and propellant into passageway 12. At entry port 13, a flow restrictor 11 is shown. When the on/off valve 9 is open, liquid enters to the entry port 13 within the restrictor 11 and passageway 12. The gaseous propellant enters at entry port 14. The pressure difference towards exit port 5 drives liquid product and gaseous propellant through the capillary tube, which causes the atomization of the liquid product inside the capillary tube. In case a canister is used to store liquid product and propellant, both are at the same pressure.

Figure 5:
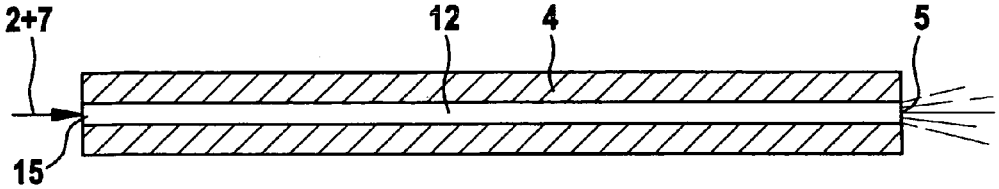
FIG. 5 shows a capillary tube used in an exemplary atomizing apparatus according to an embodiment of the invention.
Figure 6:
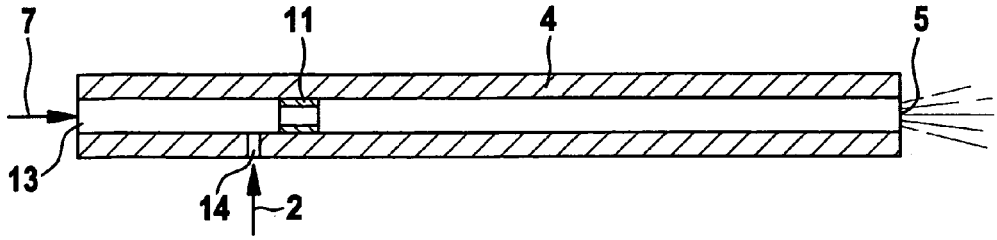
FIGS. 6, 7, 8 and 9 show different arrangements of flow restrictors for use in an exemplary atomizing apparatus according to an embodiment of the invention.
Figure 7:
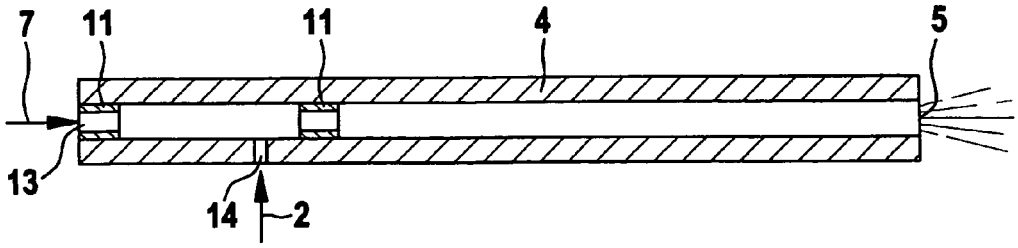
Figure 8:
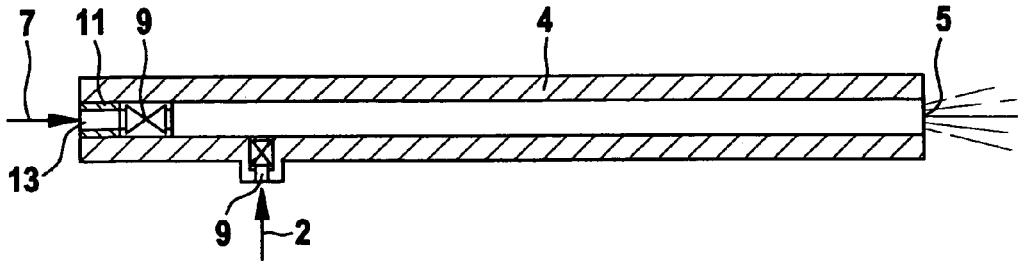
Figure 9:
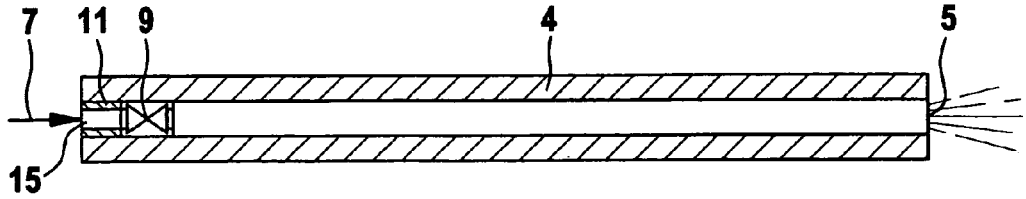

FIG. 5 shows a capillary tube 4, in which a common entry port 15 is used for allowing the entrance of propellant and liquid product in admixture.

FIGS. 6, 7, 8 and 9 show different arrangements of flow restrictors 11 and valve 9 to control the flow rates of propellant, liquid product and their admixture, respectively. Flow restrictors 11 and valves 9 can be arranged at different positions within the pathway for liquid product, propellant and their admixture, before or after the entry into the capillary tube 4.

Figure 10:
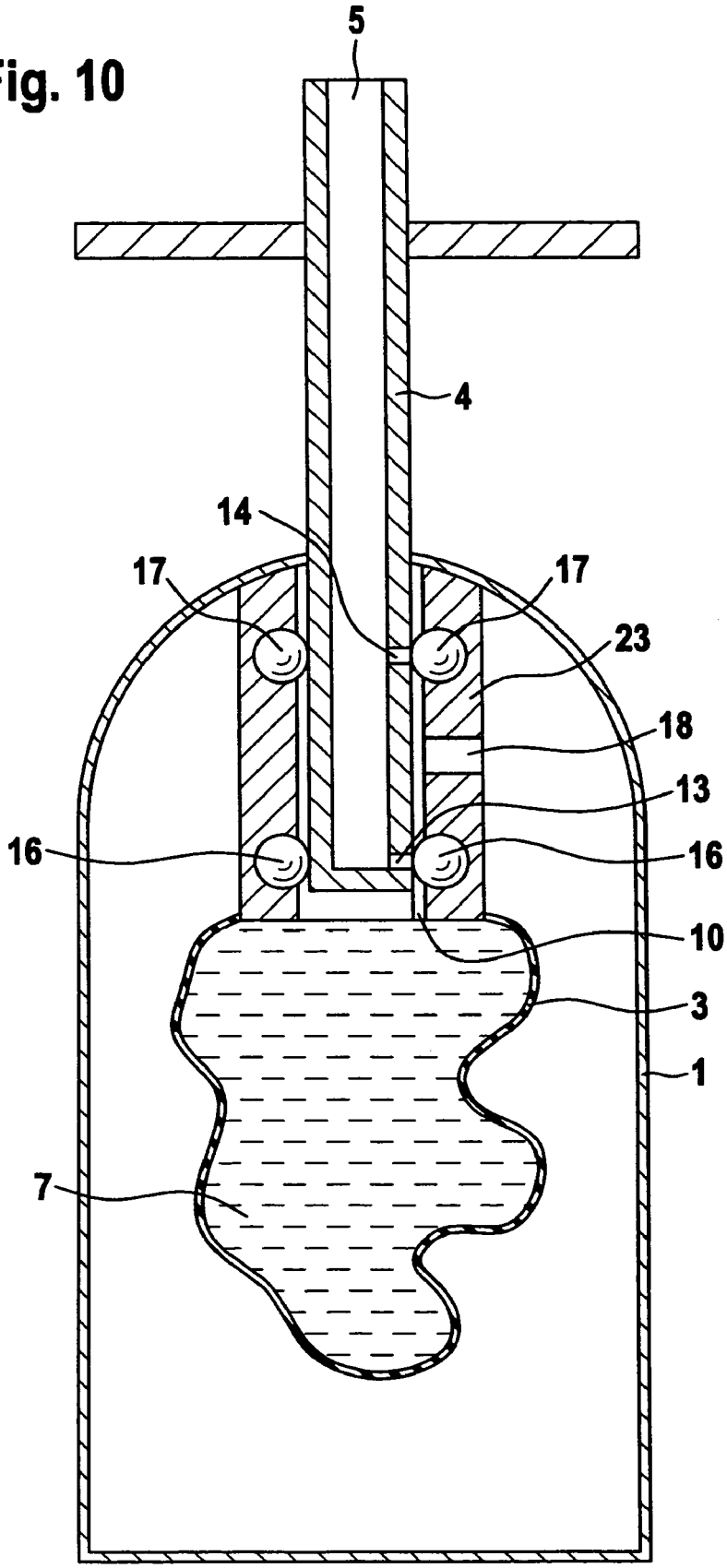
FIG. 10 shows an exemplary atomizing apparatus in the inactive state, according to an embodiment of the invention.
Figure 11:
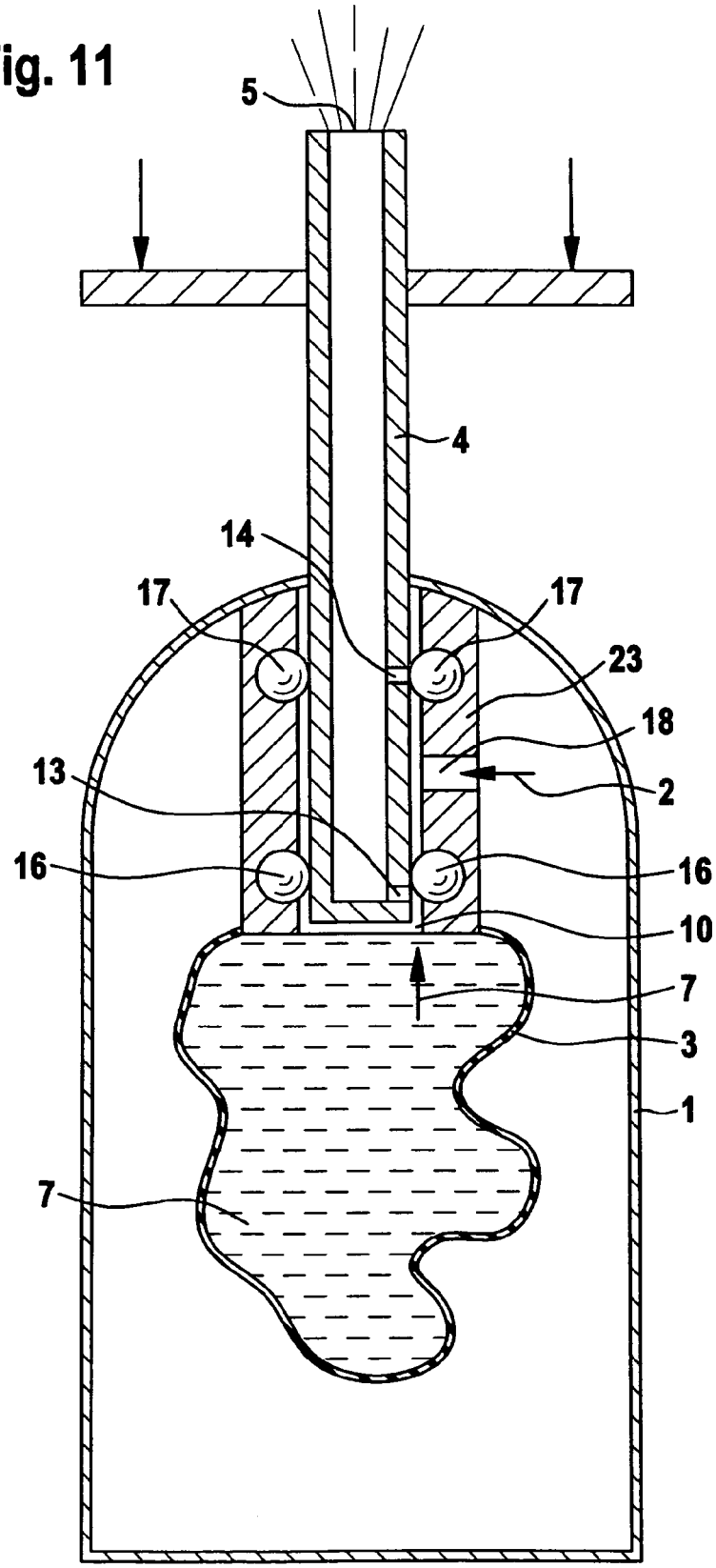
FIG. 11 shows the active state of the same exemplary atomizing apparatus as that in FIG. 10.

FIGS. 10 and 11 show a canister 1 with the attached atomizing apparatus according to the present invention. A flexible bag 3 is connected to the capillary tube 4 via a bore 10 as an afferent pathway allowing the entry of liquid product from the flexible bag 3 into the first entry port 13, which is guarded by valve arrangement 16. Propellant is admitted to the second entry port 14 via bore 18 as a second afferent pathway, allowing entry of propellant into the capillary tube via the second entry port 14, which is guarded by the valve arrangement 17. When pushing (arrow) the capillary tube 4 axially into canister 1, valve arrangements 17, 16 are opened for dispensing liquid product, being atomized within the capillary tube and being propelled by propellant through exit port 5. The valve arrangements 16, 17 may comprise an annular seal such as an O-ring. FIG. 10 shows the apparatus in the inactive state, FIG. 11 shows the same apparatus in the active state. It is noted that this embodiment avoids any cavity for the admixture of product and propellant.

Figure 12:
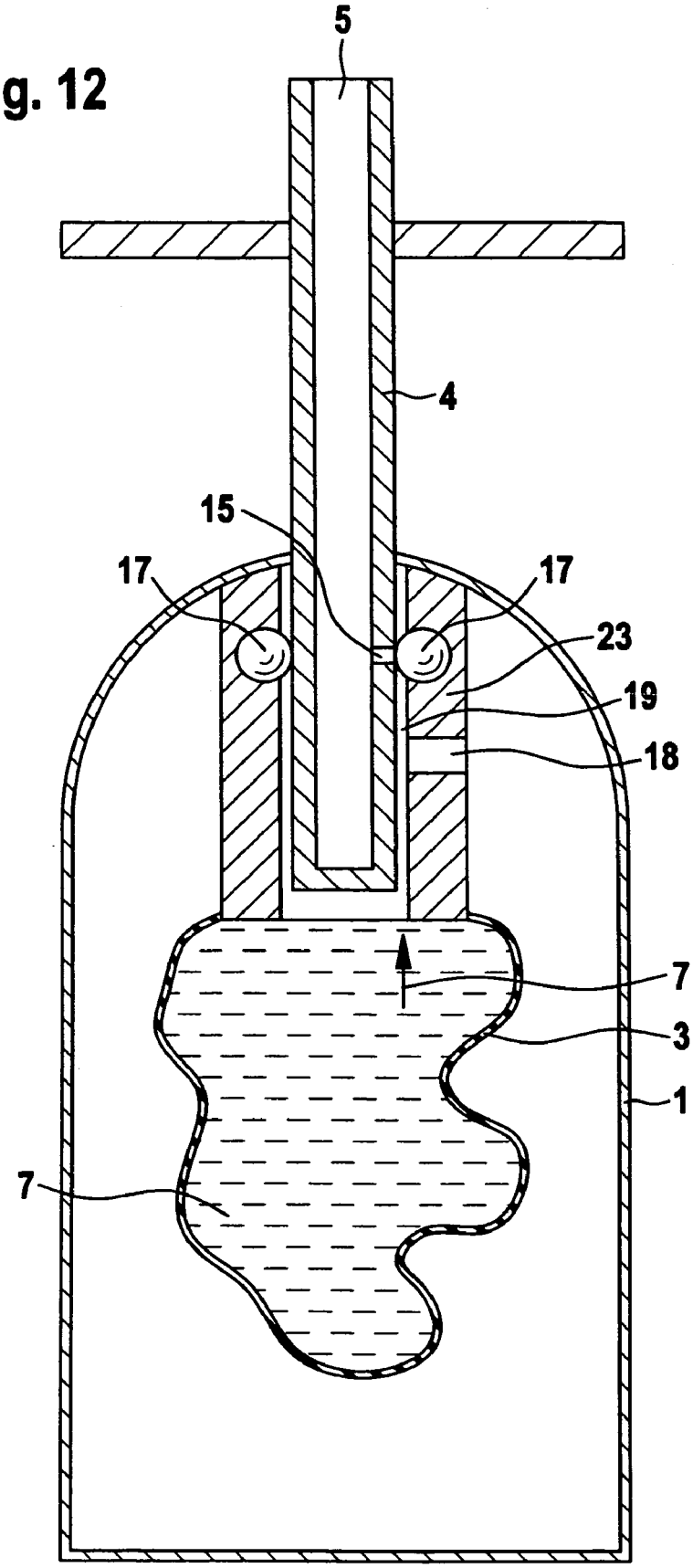
FIG. 12 shows yet another exemplary atomizing apparatus according to an embodiment of the invention.

FIG. 12 shows a similar arrangement to that of FIG. 10, but using a capillary tube 4 which is closed at its axial end opposite to the exit port 5 and has one common lateral entry port 15. The gaseous propellant 2 mixes with liquid product 7 after passing bore 18. There is no separate valve arrangement for regulating the inflow of liquid product into the capillary tube 4, however, valve arrangement 17 regulates the inflow of the mixture of gaseous propellant and liquid product into capillary tube 4 via annular cavity 19.

FIGS. 13 through 19 demonstrate embodiments of the atomizing apparatus, wherein cavity 19, arranged between afferent pathway 20 and the capillary tube 4, is dimensioned to have small volume.

Figure 13:
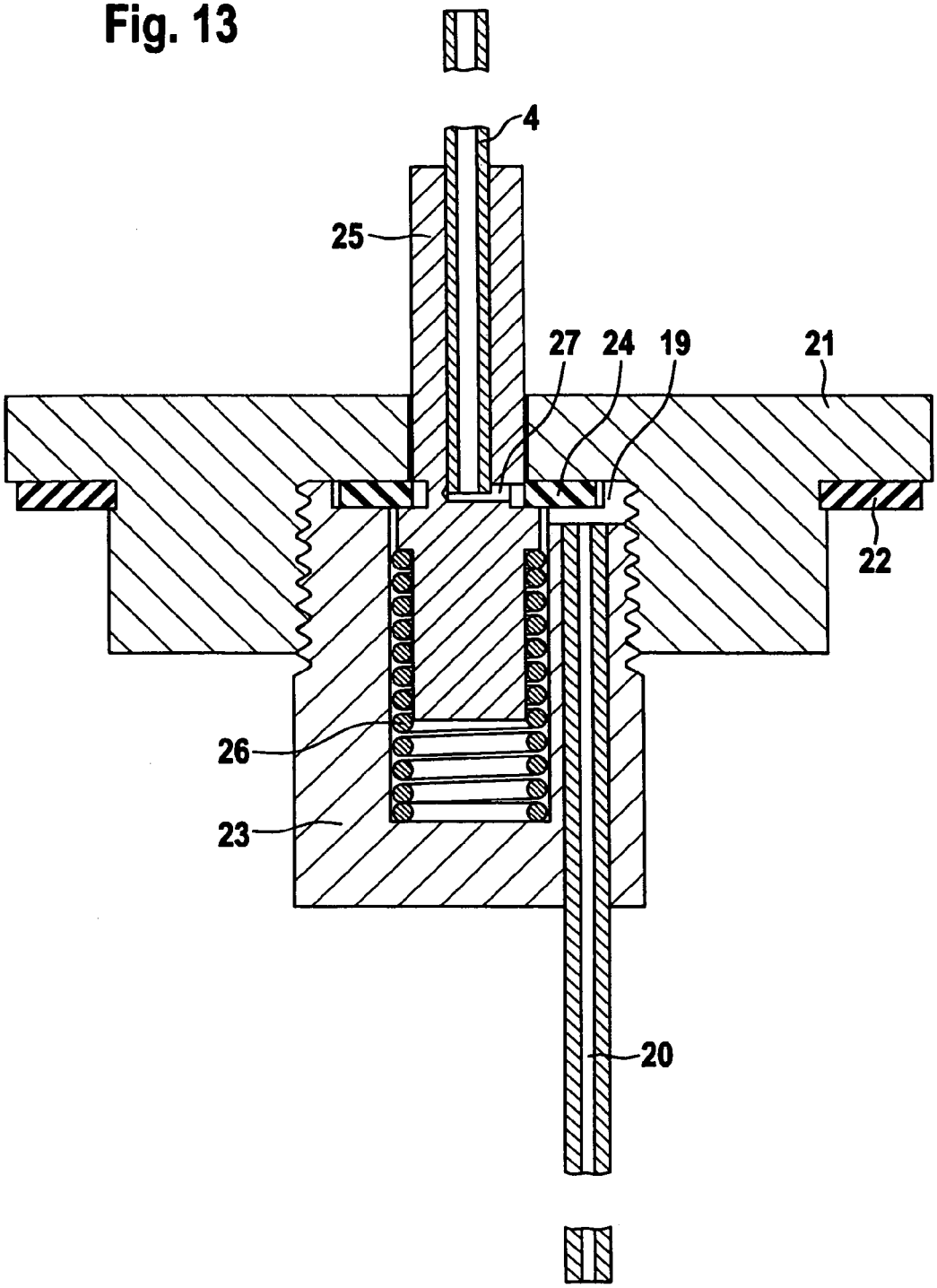
FIGS. 13, 14, 15, 16 and 17 show embodiments of the atomizing apparatus according to the present invention, each having small volume cavities.

FIG. 13 shows an exemplary atomizing apparatus according to an embodiment of the invention that is applicable, for example, in a dip-tube system using liquefied gas as the propellant. A cover or lid 21 can be seen for fastening to a gas-tight canister with a sealing ring 22. Housing 23 for a valve is threaded into a threaded bore of cover 21 and sealed by a gasket 24 to cover 21. The gasket 24 engages an annular groove of stem 25 extending outwardly through a bore of cover 21 and inwardly into the inner space of housing 23. Coil spring 26 biases the stem 25 upwardly against gasket 24. The stem 25 contains the capillary tube 4, having a small inner diameter. At the lower end of capillary tube 4, a transverse bore 27 in stem 25 is provided, which is closed by gasket 24 when coil spring 26 is in its extended state. The transverse bore 27 acts as common entry port 15, however, a transverse second bore 27 may be provided. The afferent tubing 20 is formed by a pipe which extends through an eccentric bore of the housing 23 into cavity 19.

This embodiment is suitable for so-called dip-tube systems, in which the propellant (for example, liquefied natural gas, optionally chlorinated or fluorinated) forms a liquid mixture with the liquid product and is guided as one mixture through the afferent tubing 20. In order to keep the volume of cavity 19 small, it is preferred that there is little or no connection to the space in which coil spring 26 is arranged. In other words, the inner part of stem 25 essentially seals the bore of housing 23, where coil spring 26 is contained.

Figure 14:
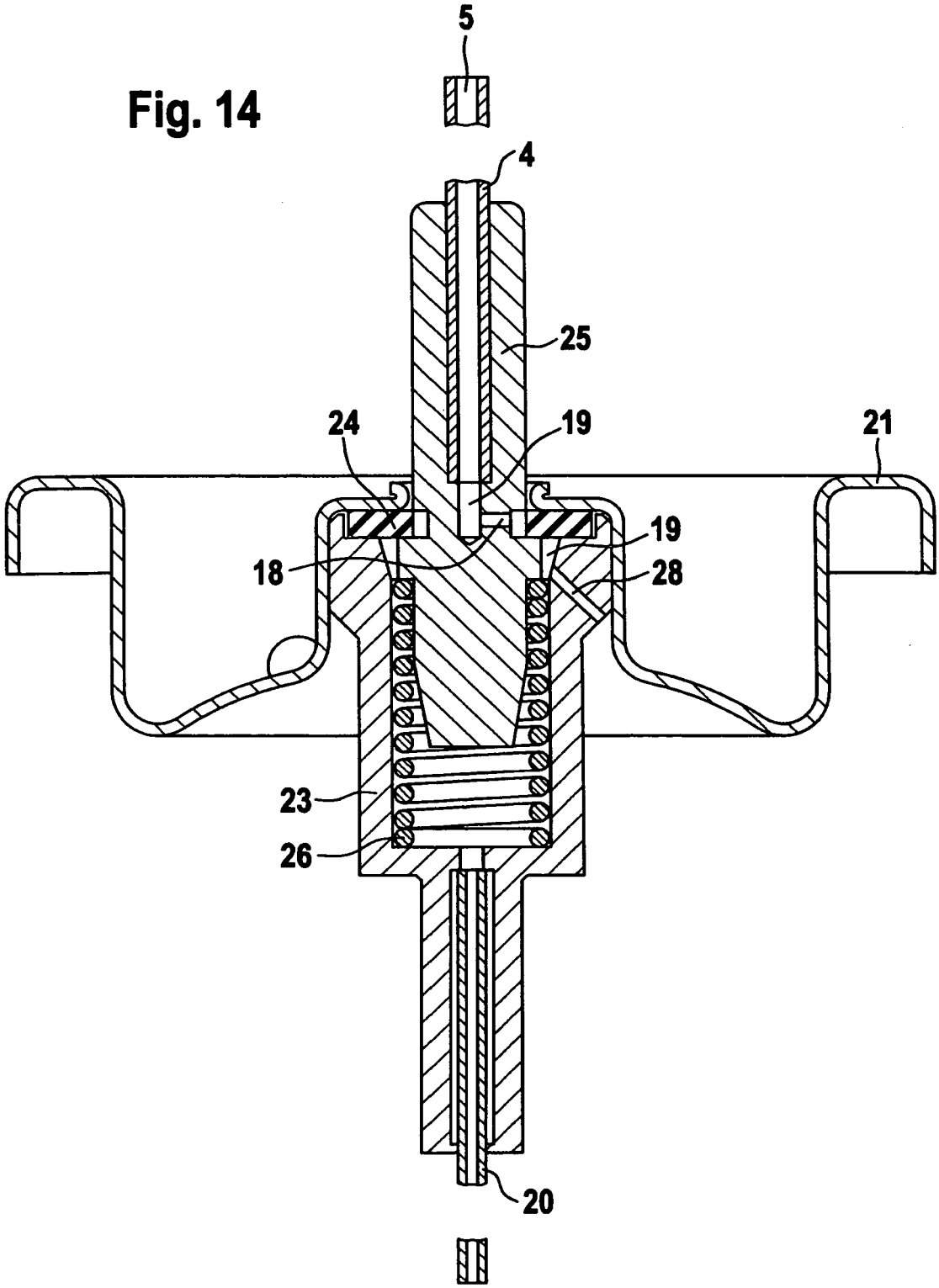

In FIG. 14 an embodiment of the invention is shown with a cover 21 which can be fastened to a conventional metal can (not shown) which is used for conventional spray packs. The housing 23 is fixed within the dome of the housing 23 and supports the afferent tubing 20. The upper part of the housing 23 contains a coil spring 26, which urges the lower part of stem 25 against sealing gasket 24, which in turn engages an annular groove of stem 25. Gasket 24 seals lateral bore 18 in the upper portion of the stem, which is connected with an elongated passage, which axially continues into capillary tube 4. The lower portion of the housing 23 has an afferent bore 28, which is connected to cavity 19, separated from the bore 18 by the gasket 24. Afferent bore 28, being positioned higher than the opening of afferent tubing 20 as suitable for admitting gaseous propellant into cavity 19, whereas afferent tubing 20 allows the entry of liquid product into the room occupied by coil spring 26 and, through an intermediate space between the bore of housing 23 and stem 25 into cavity 19. When stem 25 is pushed axially to compress coil spring 26, gasket 24 is no longer positioned to seal bore 18, now admitting the mixture of gaseous propellant and liquid product, formed in cavity 19, into capillary tube 4. Such an embodiment is suitable for so-called bag-on-valve type spray cans, in which the liquid product is physically separated from the surrounding propellant by for example a collapsible bag or a tube with movable piston, allowing pressurization of liquid product by the pressurizing propellant. The liquid product is only admitted into afferent tubing 20, whereas the gaseous propellant only enters afferent bore 28. However, such an embodiment may also be used in cases, where liquid product and propellant are not separated by a physical barrier but by phase-separation, for instance when the propellant is compressed air or compressed nitrogen, which do not form a substantial liquid phase and dissolves into the liquid product only to a small amount.

Figure 15:
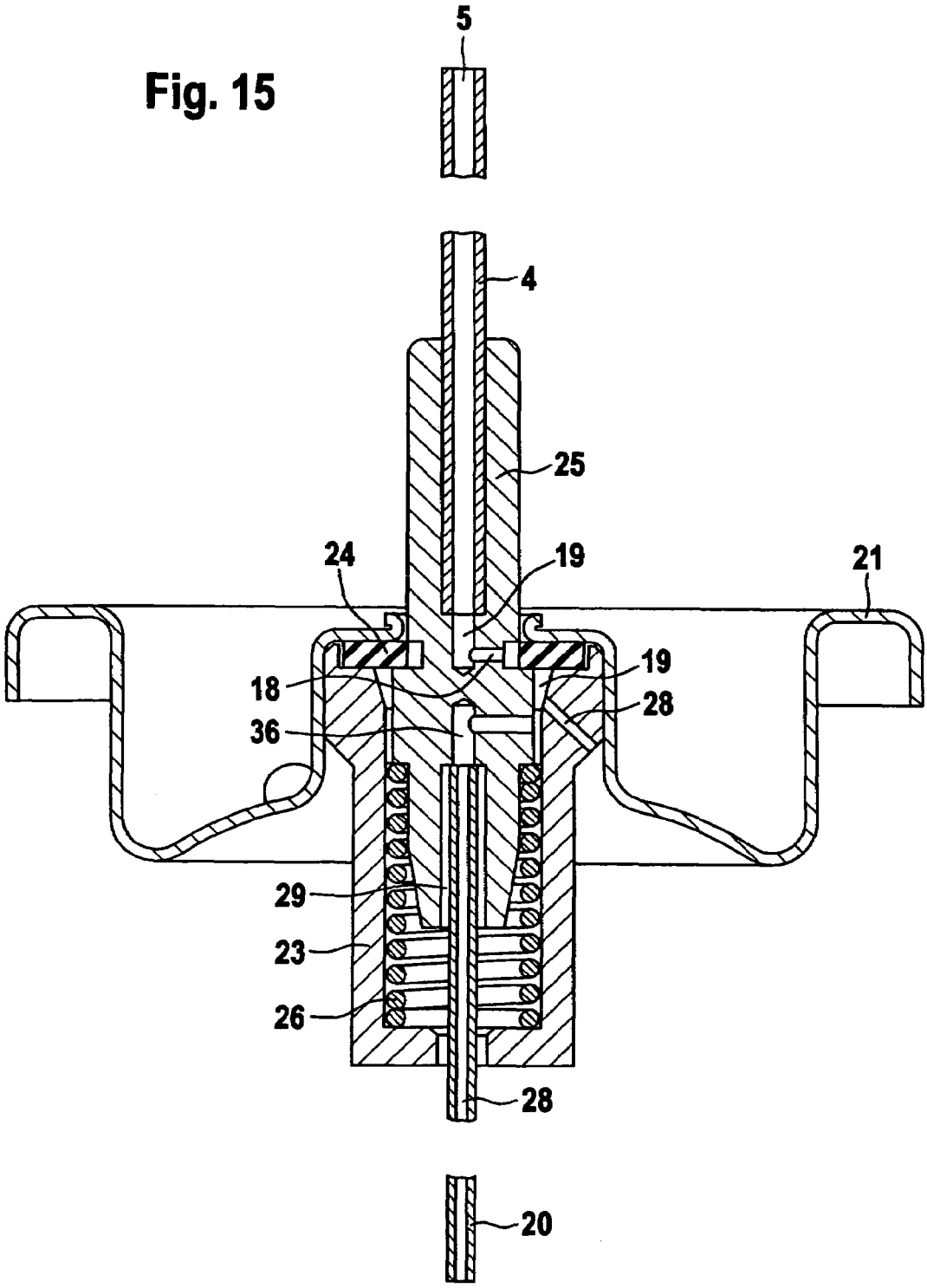

In the embodiment illustrated in FIG. 14, both liquid product and propellant are admitted via separate afferent tubings to cavity 19, where they mix and enter the capillary tube 4 when stem 25 is pushed so that gasket 24 opens the bore 18. The embodiment illustrated in FIG. 15 differs from that shown in FIG. 14. In FIG. 15, afferent bore 28, admitting propellant, is formed as an annular space between afferent tubing 20 and housing 23. Afferent tubing 20 admits liquid product via connecting bores 36 and 37 to cavity 19. The sealing 29 prevents removal of afferent tubing 20 and admixture of propellant and liquid product prior to their entering cavity 19. The embodiment shown in FIG. 15 may be used for the same applications as that of FIG. 14.

Figure 16:
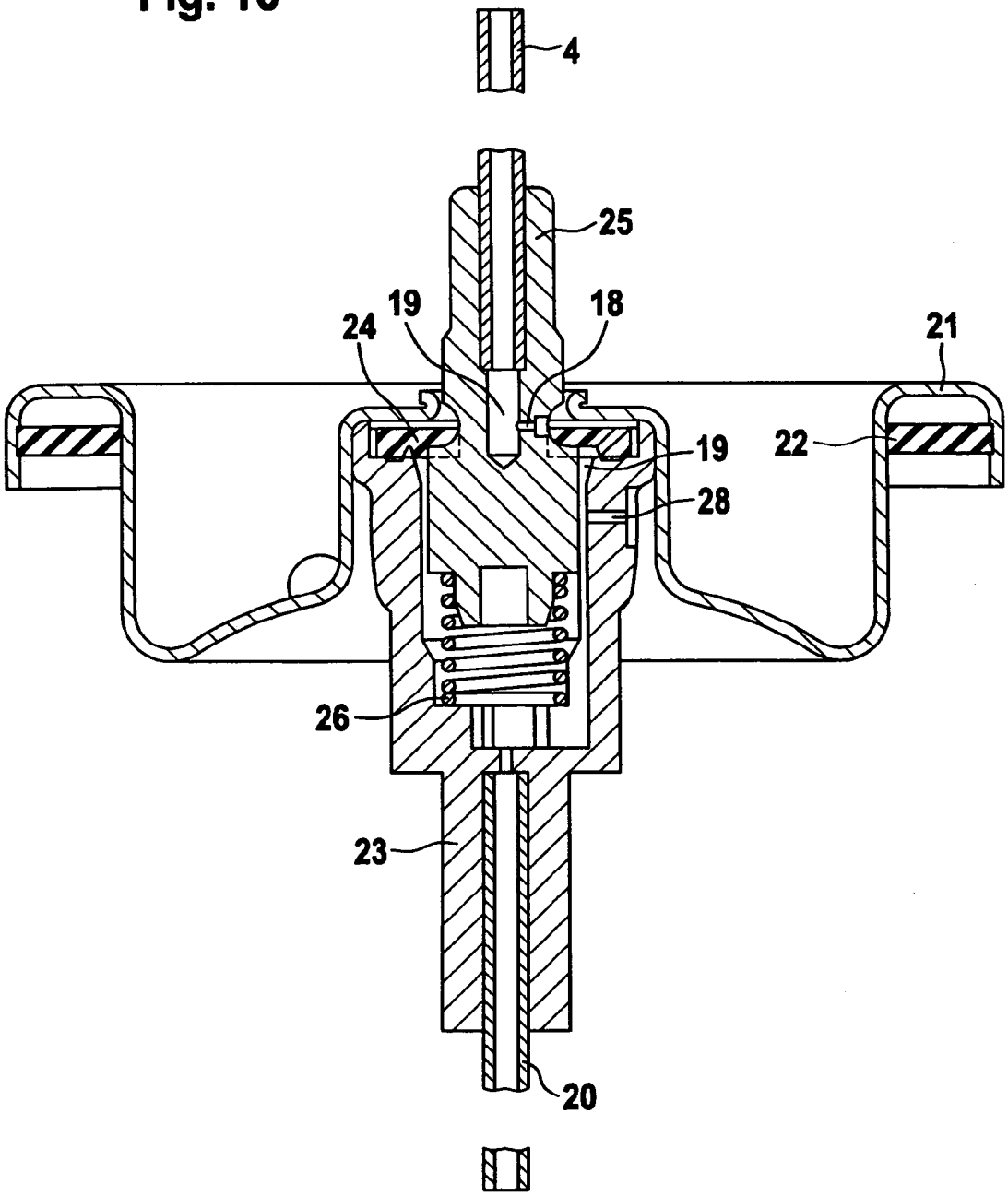

As an alternative embodiment, FIG. 16 shows afferent tubing 20 for liquid product and bore 28 for gaseous propellant, respectively, before they are admitted to cavity 19. Cavity 19 opens into a lateral bore 18 when stem 25 is pushed axially for removal from gasket 24 and further connects to capillary tube 4. This embodiment may be used for the same applications as that of FIG. 14.

Figure 17:
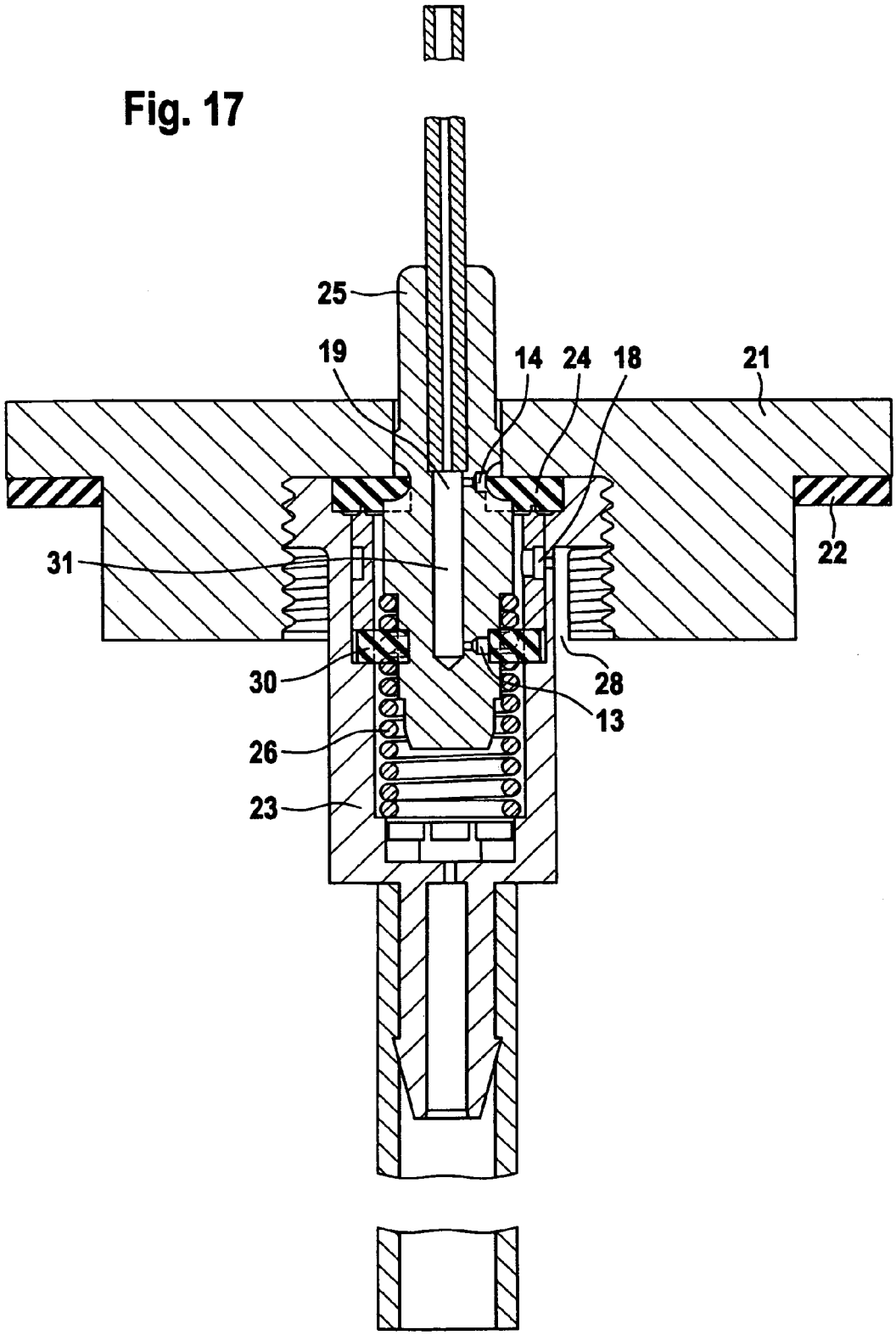

In FIG. 17, liquid product is admitted by afferent tubing 20, which allows entry into the space occupied by coil spring 26 within housing 23. Gasket 30 seals the first entry port 13 and gasket 24 seals the second entry port 14, when coil spring 26 urges stem 25 in its extended state. Afferent bore 28 connects to an annular space between housing 23 and stem 25 via lateral bore 18. When pressing stem 25, second entry port 14 is opened by removal from gasket 24, whereas first entry port 13 is opened by removal from gasket 30 to allow gaseous propellant and liquid product, respectively, to enter into space 31, which connects to the capillary tube 4. In an upright position, however, space 31 is filled with liquid product and a cavity 19 forms at the top end of space 31 adjacent capillary 4. This embodiment is suitable for the same purposes as the embodiment of FIG. 14.

Figure 18:
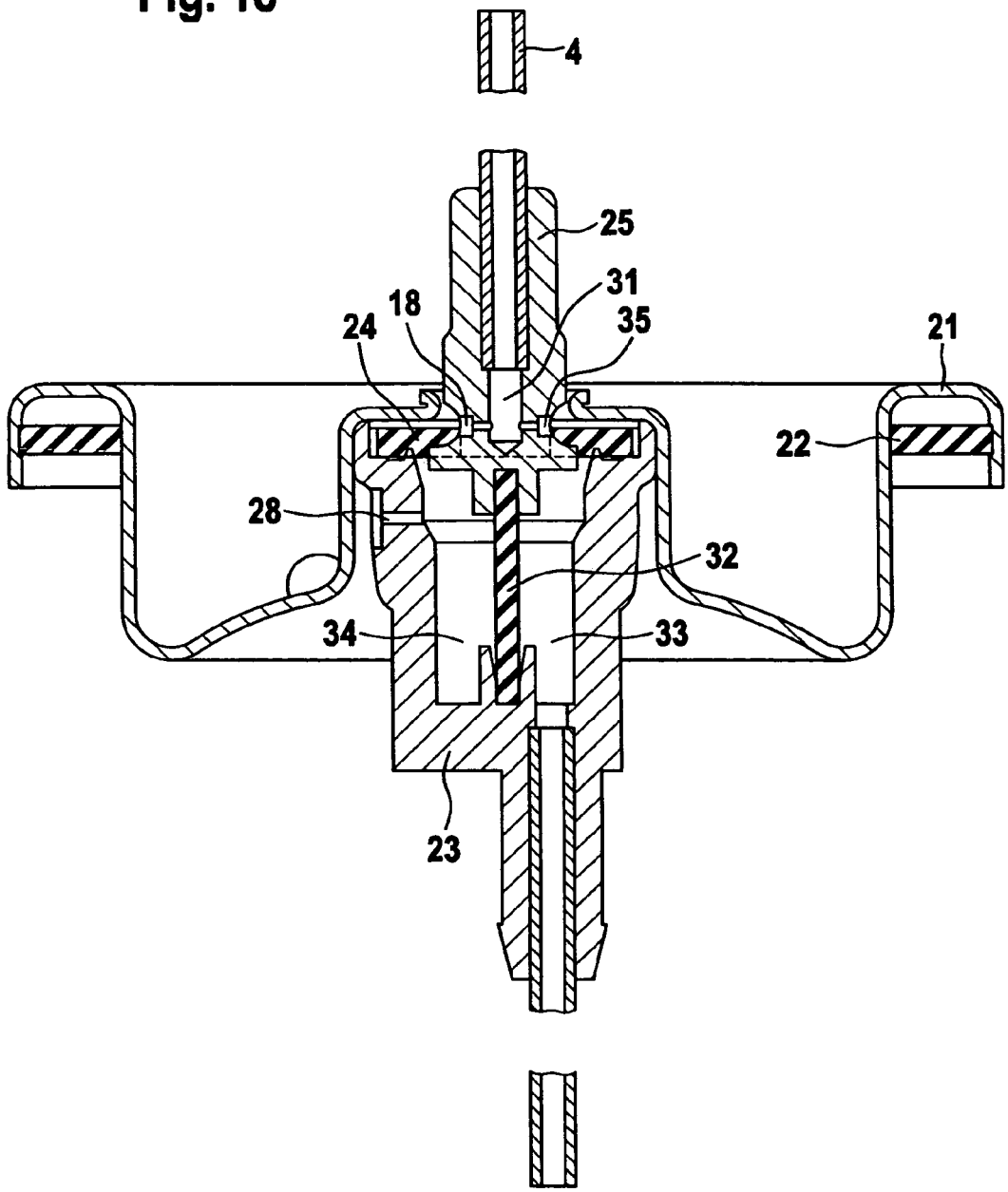

In FIG. 18, afferent tubing 20 conducts liquid product into a chamber 33, separated from chamber 34 by interposed flexible partition wall 32. The flexible partition wall 32 is received in annular grooves of stem 25 and housing 23, respectively, biasing stem 25 against cover 21. Chamber 33 may connect to lateral bore 35 when gasket 24 is bent by depressing stem 25. Gaseous propellant is admitted via lateral bore 28 into chamber 34, which connects to bore 18 when gasket 24 is bent by the stem 25 being depressed. Within space 31, corresponding to cavity 19, liquid product and gaseous propellant are mixed before entering the capillary tube 4, thus avoiding substantial cavities within the afferent pathway of the mixture of liquid product and propellant before capillary tube 4. The embodiment of FIG. 18 may be used for the same purposes as the embodiment according to FIG. 14.

Figure 19:
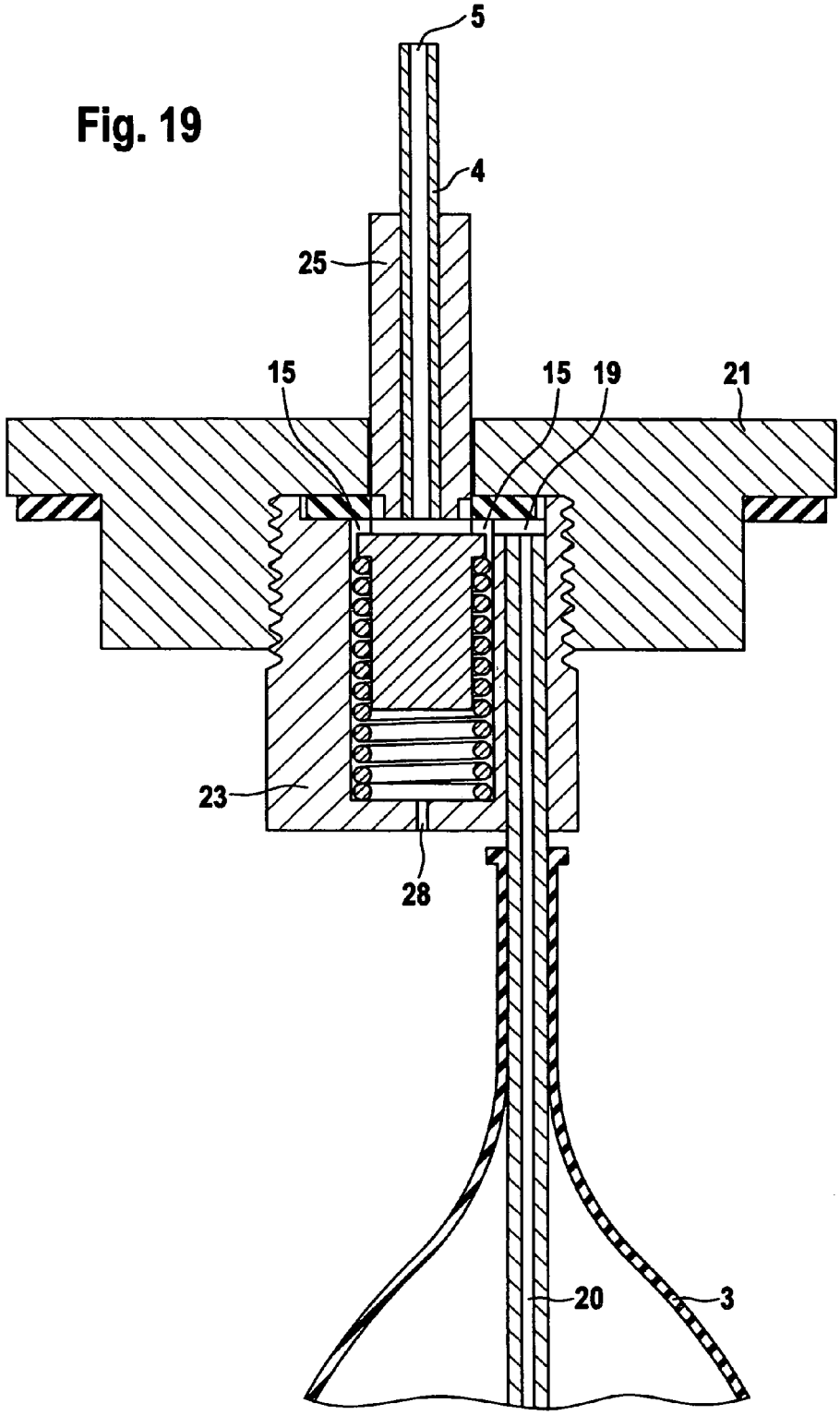
FIG. 19 shows an exemplary "bag-on-valve" type arrangement of an atomizing apparatus according to an embodiment of the invention.

FIG. 19 shows a "bag on valve" arrangement of the apparatus according to the invention. The gaseous propellant enters through afferent bore 28. The liquid product is stored in flexible bag 3 and enters through afferent tubing 20 discharging the liquid product into cavity 19 where it is mixed with the gaseous propellant. The mixture enters the capillary tube 4 via common entry port 15.

In describing representative embodiments of the invention, the specification may have presented the apparatus of the invention and processes employing the liquid atomizing apparatus as a particular combination of components. However, to the extent that the apparatus or process does not rely on the particular configuration as set forth herein, the apparatus and process of the invention should not be limited to the order written, and skilled in the art can readily appreciate that the components may be varied and still remain within the spirit and scope of the invention.

The foregoing disclosure of the embodiments of the invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

I claim:

1. Apparatus for atomizing a liquid product using pressure of a gaseous propellant, wherein the liquid product is atomized within a capillary tube, the apparatus allowing a total flow rate of 0.5 g/s to 0.01 g/s through a single capillary tube, comprising:

at least one valve for operating the apparatus, said valve comprising a valve body, a valve spring and a valve gasket sealingly cooperating with the valve body, at least one capillary tube having an exit port at one end thereof in an axial direction for discharge of atomized liquid product and gaseous propellant, and an entry port into the capillary tube for entry of the liquid product and the propellant in admixture at the opposite end thereof, said capillary tube having a sufficient internal diameter and length between the exit port and the entry port to allow atomization of the liquid product by the propellant, and at least one afferent pathway for delivery of the liquid product and the propellant in admixture to said entry port, wherein the afferent pathway comprises at least one of:

an afferent tubing for the liquid product and the propellant in admixture from a supply of liquid product and propellant to an internal cavity formed between the afferent tubing and said capillary tube, and said afferent tubing for the liquid product or the liquid product and the propellant in admixture from a supply of liquid product or the supply of the liquid product and propellant in admixture to said internal cavity formed between the afferent tubing and said capillary tube, and at least another afferent tubing for gaseous propellant from a supply of gaseous propellant to said internal cavity, wherein said valve body, valve spring and valve gasket of said valve for operating apparatus are positioned within said internal cavity of said afferent pathway with the valve gasket positioned at said entry port of said capillary tube, and wherein said internal cavity has an internal cavity volume of below 50 $mm^3$.

2. The apparatus of claim 1, wherein the entry port has a diameter to allow entrance of the liquid product and the gaseous propellant from the cavity in a volumetric flow ratio of liquid product to gaseous propellant from about 1:50 to about 1:5000, wherein said liquid product is mixed with liquefied propellant within a compartment which is connected to said afferent pathway.

3. The apparatus of claim 2, wherein said volumetric flow ratio of liquid product to gaseous propellant is from about 1:100 to about 1:300.

4. The apparatus of claim 1, wherein the distance between the exit port and the entry port is from about 5 mm to about 100 mm.

5. The apparatus of claim 4, wherein said distance is from about 5 mm to about 50 mm.

6. The apparatus of claim 1, wherein said entry port has a diameter of from about 0.1 mm to about 1.0 mm.

7. The apparatus of claim 6, wherein said diameter is from about 0.2 mm to about 0.6 mm.

8. The apparatus of claim 1, wherein said cavity has an internal volume of below 20 $mm^3$.

9. The apparatus of claim 8, wherein said volume is below 6 $mm^3$.

10. The apparatus of claim 9, wherein said volume is below 2 $mm^3$.

11. The apparatus according to claim 1, wherein the capillary tube is bent.

12. The apparatus according to claim 1, wherein the capillary tube is coiled.

13. The apparatus according to claim 1, wherein said internal cavity has a maximum cavity volume that, at a given pressure of the propellant and viscosity of the product, is a direct function of the capillary tube internal diameter in mm divided by the ratio of the diameters in mm of the entry port for propellant to the entry port for liquid product.

14. The apparatus according to claim 13, wherein said internal cavity has a maximum cavity volume in accordance with the following relationships:

at a viscosity of 50 mPa ·s:

$$\text{Maximum cavity volume allowed} = \text{Pressure}^{1.5} \exp[(d/R - 0.62\ 1)/0.2022]$$

At a viscosity of 1 mPa ·s:

$$\text{Maximum cavity volume allowed} = \text{Pressure}^{1.5} \exp[(d/R - 0.4274)/10.1917],$$

where d is the capillary tube internal diameter in mm, and wherein R is the ratio of the diameters of the entry port for propellant to the entry port for liquid product, and wherein the internal diameter of the capillary tube is given in mm, the pressure is gauge and is given in bars and the maximum volume cavity allowed is calculated in $mm^3$.

* * * * *